US005353625A

United States Patent [19]

Hoshino et al.

[11] Patent Number: 5,353,625

[45] Date of Patent: Oct. 11, 1994

[54] TERMINAL CRIMPING MACHINE

[75] Inventors: Atsushi Hoshino; Toshihiro Inoue, both of Shizuoka, Japan

[73] Assignee: Yazaki Corporation, Tokyo, Japan

[21] Appl. No.: 139,827

[22] Filed: Oct. 22, 1993

[30] Foreign Application Priority Data

Oct. 23, 1992 [JP] Japan ..... 4-285933

[51] Int. Cl.[5] ..... H01R 43/048

[52] U.S. Cl. ..... 72/416; 72/427; 72/461; 29/753

[58] Field of Search ..... 72/416, 410, 461, 427; 29/753, 751

[56] References Cited

U.S. PATENT DOCUMENTS

| | | | |
|---|---|---|---|
| 3,263,316 | 8/1966 | Schrader | 29/753 |
| 3,523,351 | 8/1970 | Filia | 29/751 |
| 3,969,806 | 7/1976 | McCaughey | 29/753 |
| 4,598,570 | 7/1986 | Baldyga | 72/461 |
| 4,630,462 | 12/1986 | Wiener | 72/427 |
| 4,754,636 | 7/1988 | Kautz | 29/751 |

FOREIGN PATENT DOCUMENTS 5673876 11/1979 Japan .

*Primary Examiner*—Daniel C. Crane

*Attorney, Agent, or Firm*—Sughrue, Mion, Zinn, Macpeak & Seas

[57] ABSTRACT

An object of the present invention is to provide a terminal crimping machine which assures that undesirable bending of a cable caused due to the fact that a terminal firmly fitted into a crimper is raised up together with the crimper after the time of terminal crimping is reduced as far as possible. A terminal crimping machine includes a crimper 3, an anvil 4 located opposite to the crimper 1, and a stopper 13 composed of a terminal disconnecting piece 14 and an arm piece 15, and the arm piece 15 is turnably disposed on a guide frame 11 of the ram 2 to turn about a pin 12. A tension spring 20 is bridged between the arm piece 15 and a spring fixing piece 19. As the ram 2 is lowered, it comes in slidable contact with the arm piece 15 so as to allow the arm piece 15 assume an upright attitude. At this time, the terminal disconnecting piece 14 is located at the terminal disconnecting position higher than the anvil 4 by a predetermined distance. When the crimper 3 is raised up in excess of the terminal disconnecting position, the arm piece 14 is disengaged from the ram 2, causing the stopper 13 to be turned to the crimper 3 side by the resilient power of the tension spring 20. When the ram 2 reaches an upper dead point, an outer edge portion 16 of the stopper 13 is located inside of the lower end of the crimper 3.

6 Claims, 8 Drawing Sheets

TERMINAL CRIMPING MACHINE

BACKGROUND OF THE INVENTION

The present invention relates generally to a terminal crimping machine for producing a cable integrated with a terminal to serve as a wire harness or the like. More particularly, the present invention relates to a terminal crimping machine of the foregoing type wherein the extent of bending of the cable after completion of a crimping operation is reduced as far as possible.

In FIG. 7 and FIG. 8, reference numeral 1 designates a conventional terminal crimping machine. This conventional terminal crimping machine 1 includes a ram 2, a crimper 3 adapted to be raised up and lowered together with the ram 2 fixedly secured to the crimper 2, an anvil 4 located opposite to the crimper 3, an anvil stand 5, a stationary terminal releasing stopper 6, and a terminal correcting guide 7.

To crimp a cable 9 with a terminal 10, first, the cable 9 is firmly held by a clamp 8 in the clamped state. While the foregoing state is maintained, the terminal 10 is then placed on the anvil 4 between the crimper 3 and the anvil 4, and subsequently, as shown in FIG. 9(A) and FIG. 9(B), the ram 2 is lowered until the cable 9 is crimped with the terminal 10 between the crimper 3 and the anvil 4 in the clamped state (the lowering of the ram 2 may be accompanied by raising-up of the anvil 4). When the terminal 10 assumes an inclined attitude relative to the cable 9, the inclined state of the terminal 10 is corrected so as to allow the terminal 10 to linearly extend in the horizontal direction by depressing an electrical contact portion 10*a* of the terminal 10 with the terminal correcting guide 7 directly before the cable 9 is crimped by the crimper 3.

After completion of the crimping operation, a cable connecting portion 10*b* of the terminal 10 is forcibly fitted into a recess portion 3*a* of the crimper 3 serving as a crimping surface. As shown in FIG. 10(A) and FIG. 10(B), as the terminal 10 is raised up together with the crimper 3, it collides against the stopper 6, causing the terminal 3 to be squeezed out of the recess portion 3*a* of the crimper 3 at the collision position.

As shown in FIG. 10(A), when the terminal 10 is raised up while it is seized by the crimper 3, bending M occurs with the cable 9. Subsequently, when the cable 9 is disengaged from the crimper 3 due to collision of the cable 9 against the stopper 6, it is reversely bent by the reactive power induced by the foregoing collision. Thus, there arises an occasion that the electrical contact portion 10*a* of the terminal 10 at the foremost end part of the latter is offset from the stopper 6 in the leftward direction or in the rightward direction as represented by phantom lines in FIG. 10(B). In the case that the electrical contact portion 10*a* of the terminal 10 is offset on the opposite side (i.e., on the right-hand side as represented by R in the drawing) relative to the conveyance direction P of the clamp 8, any significant problem does not appear. On the contrary, in the case that it is offset on the left-hand side L, i.e., in the same direction as the conveyance direction P of the clamp 8, it interferes with the clamp 8 again as the latter is intermittently displaced, causing the cable 9 to be bent by a larger angle of $\theta$ in the rightward direction as shown in FIG. 11. Thus, this bending M' overlaps the bending M (as shown in FIG. 10(A)), whereby the cable 9 and the terminal 10 are bent in the slantwise upward direction reverse to the conveyance direction P of the clamp 8.

In the case that a terminal pass checker (not shown) is disposed at a predetermined position in the vicinity of the terminal crimping machine 1 in order to determine whether the cable 9 is correctly crimped in the terminal 10 by the crimper 3 or not, the terminal 10 interferes with the checker due to the bending represented by M and M' before it reaches the predetermined detecting position. Thus, the terminal 10 is additionally bent without any possibility of checking the correctly crimped state of the cable 9.

SUMMARY OF THE INVENTION

The present invention has been made in consideration of the aforementioned background and its object resides in providing a terminal crimping machine of the foregoing type which assures that a terminal and a cable are few bent after completion of a crimping operation without any possibility that the terminal interferes with a stopper during conveyance of the cable together with the terminal, and moreover, subsequent treatments such as checking of the correctly crimped cable, fitting of the cable into a case and so on can smoothly be achieved.

To accomplish the above object, the present invention provides a terminal crimping machine including a crimper vertically slidably fitted to a ram, an anvil located opposite to the ram, and a stopper adapted to come in contact with a cable to crimp the cable with the crimper in a terminal at the lower dead point of the ram while holding the cable between the crimper and the anvil, the stopper serving to disconnect the cable away from the crimper as the cable firmly fitted into the crimper and seized by the same is raised up, wherein the terminal crimping machine is characterized in that the stopper includes a terminal disconnecting piece and an arm piece for supporting the latter, the arm piece is turnably disposed on one of a pair of guide frames each serving to properly guide slidable raising/lowering of the ram, and moreover, biasing means for normally biasing the stopper to the crimper side is disposed on the stopper, that when the ram is lowered from the upper dead point to reach the lower dead point, the ram is slidably engaged with the arm piece of the stopper so as to allow the arm piece to assume an upright attitude, that while the ram is held at the lower dead point, the terminal disconnecting piece is located at the terminal disconnecting position higher than a crimping surface of the crimper by a predetermined distance, that when the crimping surface of the crimper is displaced to the position higher than the terminal disconnecting position, the arm piece is disengaged from the arm, causing the arm piece to be turned to the crimper side by the resilient power of the biasing means so as to assume an inclined attitude, and that when the ram reaches the upper dead point, an outer edge portion of the stopper is located inside of the lower end of the crimper.

When the crimper is raised up to reach the terminal disconnecting position higher than the crimping position by a predetermined distance while the terminal is firmly fitted into the crimper and seized by the same after completion of a crimping operation, the terminal collides against the terminal disconnecting piece of the stopper, causing the crimper to be disengaged from the terminal. This mode of operation is coincident with that of the conventional terminal crimping machine. According to the present invention, however, the stopper is turned to the crimper side by the resilient power of the biasing means after the crimper reaches the upper dead point from the position slightly higher than the terminal disconnecting position, and while the crimper is held at the upper dead point, the outer edge portion of the stopper is retracted inside of the lower end of the crimper. Thus, any obstacle such as a conventional stationary stopper or the like is not present between the anvil and the stamper.

Thus, after completion of the crimping operation, the cable integrated with the terminal is conveyed between the anvil and the crimper without any interference with the stopper, whereby undesirable bending of the cable can be minimized, and moreover, any subsequent treatment can easily be achieved.

DETAILED DESCRIPTION OF THE PREFERRED EMBODIMENTS

The present invention will now be described in detail hereinafter with reference to the accompanying drawings which illustrate a few preferred embodiments thereof.

Figure 1:
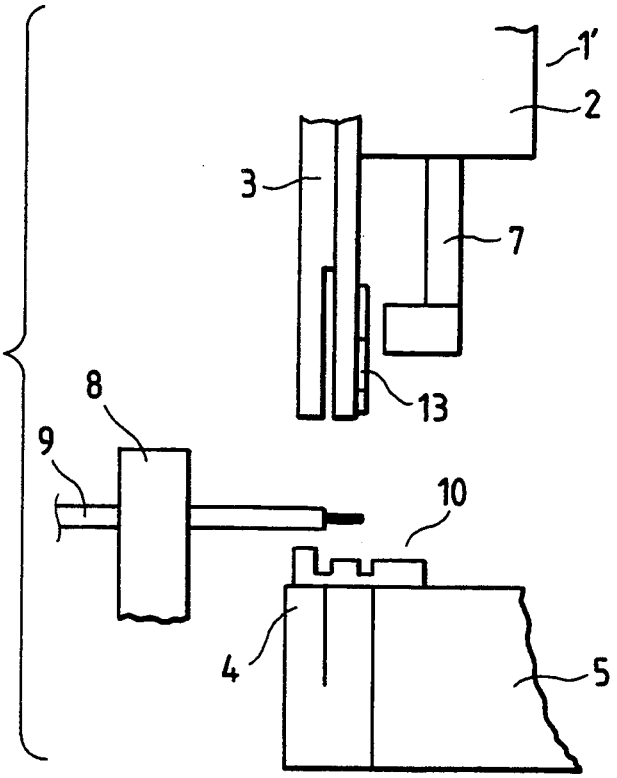
FIG. 1 is a side view of a terminal crimping machine constructed according to an embodiment of the present invention, particularly showing essential components constituting the terminal crimping machine.
Figure 2:
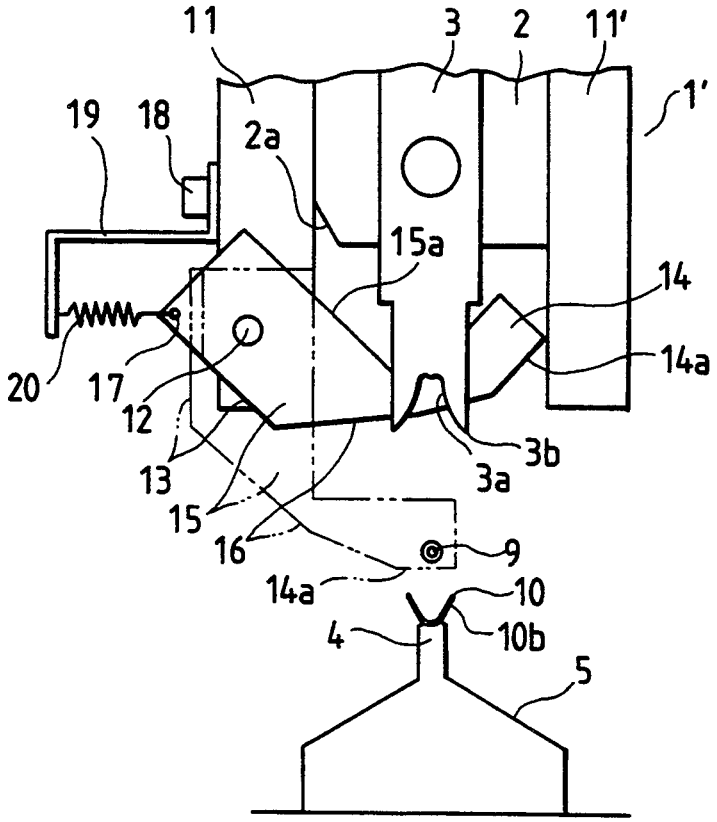
FIG. 2 is a front view of the terminal crimping machine shown in FIG. 1, particularly showing the arrangement of a crimper and an anvil.

FIG. 1 is a side view of a terminal crimping machine constructed according to an embodiment of the present invention, particularly showing essential components constituting the terminal crimping machine, and FIG. 2 is a fragmentary front view of the terminal crimping machine shown in FIG. 1. Incidentally, same components as those constituting the conventional terminal crimping machine described above with reference to FIG. 7 to FIG. 11 are represented by same reference numerals.

Referring to FIG. 1 and FIG. 2, a terminal crimping machine 1' includes a pair of guide frames 11 and 11' arranged on the opposite sides of a ram 2 for properly guiding slidable raising/lowering of the ram 2, and a stopper 13 is pivotably disposed on one of the stoppers 11 and 11', i.e., the left-hand stopper 11 to pivot about a pin 12. The stopper 13 is designed in the form of a L-shaped link composed of a terminal disconnecting piece 14 and an arm piece 15 for holding the latter, and the upper end part of the arm piece 15 is pivotably supported by the pin 12. An outer edge portion 16 of the stopper 13 having the arm piece 15 and the terminal disconnecting piece 14 intersecting each other is tapered (or exhibits an arc-shaped contour).

A spring fixing piece 19 is secured to the guide frame 11 by tightening a bolt 18, and a tension spring 20 serving as biasing means for biasing the stopper 13 to the crimper 13 side is bridged between the spring fixing piece 19 and a left-hand shoulder portion of the arm piece 15.

Thus, the stopper 13 is normally biased by the resilient power of the tension spring 20 in such a manner as to pivot the stopper 13 about the pin 12 in the anticlockwise direction. With this construction, when the ram 22 is raised up to assume an upper dead position while it is disengaged from the stopper 13, the arm piece 15 assumes an inclined attitude and the outer edge portion 16 of the arm piece 15 is located inside of a lower end **3*b* of the clipper 3. On the contrary, when the ram 2 is lowered to come in slidable contact with an inner edge portion 15*a* of the arm piece 5 so that the arm piece 15 exhibits an upright attitude as represented by phantom lines, a lower end surface 14*a* of the terminal disconnecting piece 14 is located at the position directly above the anvil 4 (or a terminal 10**), i.e., at the terminal disconnecting position.

Next, a terminal crimping operation and an operation of the stopper 13 will be described below.

Referring to FIG. 1 and FIG. 2, while a cable 9 is held by a clamp 8 in the clamped state, a terminal 10 is supplied to the space between the crimper 3 and the anvil 4 with the ram 2 located at the upper dead point. This state is coincident with that of the conventional terminal crimping machine with the exception that the stopper 13 assumes an inclined attitude by the resilient power of the tension spring 20, and moreover, the outer edge portion 16 of the stopper 13 is located inside of the lower end **3*a* of the crimper 3**.

Figure 3A:
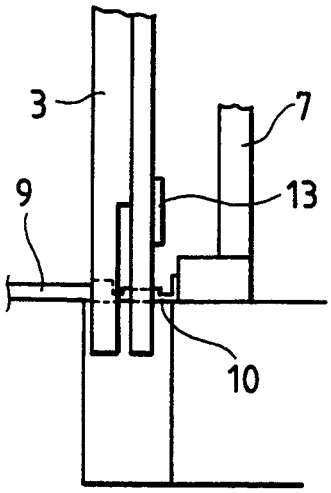
FIG. 3(A) is a fragmentary side view of the terminal crimping machine shown in FIG. 1 at the time of terminal crimping.
Figure 3B:
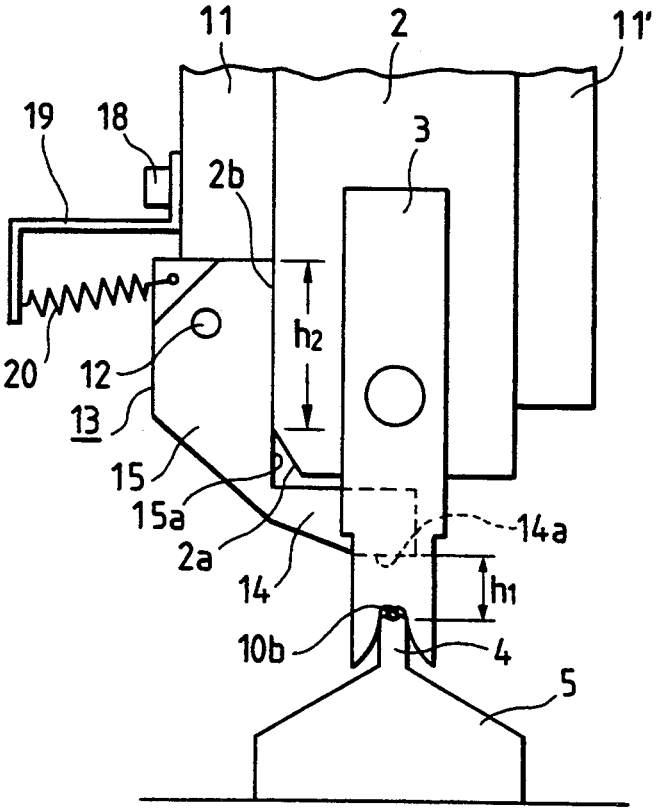
FIG. 3(B) is a front view of the terminal crimping machine shown in FIG. 3(B).

Subsequently, as shown in FIG. 3(A) and FIG. 3(B), as the crimper 3 is lowered, an electrical connecting portion **10*b* of the terminal 10 is compressed between the crimper 3 and the anvil 4, whereby the cable 9 is firmly crimped by the crimper 3 in the terminal 10**.

When a taper portion **2*a* of the ram 2 at the lower end part of the latter comes in contact with an inner edge portion 15*a* of the arm piece 15 during the lowering movement of the crimper 3, i.e., the ram 2, the arm piece 15 of the stopper 13 held in the inclined state is caused to turn about the pin 12 in the clockwise direction, and thereafter, a side edge portion 2b of the ram 2 comes in slidable contact with the inner edge portion 15a of the arm piece 15, causing the arm piece 15 to assume an upright attitude. While the arm piece 15 assumes the upright attitude, a lower end surface 14a of the terminal disconnecting piece 14 is located at the terminal disconnecting position directly above the anvil 4 (or the crimping surface of the crimper 3) with a predetermined height $h_1$ kept therebetween. This upright attitude is maintained until the ram 2 reaches the lower dead point, i.e., until the crimper 3 reach the crimping position. In the drawings, reference character $h_2$ designates a length of slidable displacement of the ram 2 and the stopper 13 or the range where they are slidably displaced. When the ram 2 is slidably displaced in the upward direction away from the foregoing range, the stopper 13 assumes the inclined attitude by the resilient power of the tension spring 20**.

Figure 4A:
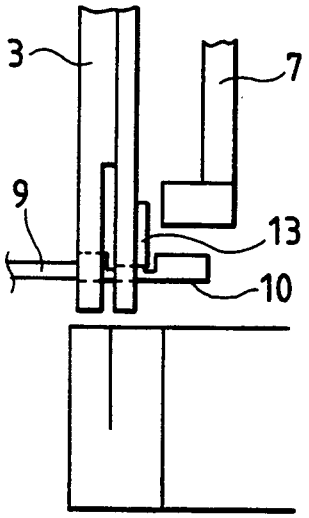
FIG. 4(A) is a fragmentary side view of the terminal crimping machine when a crimper is raised up from a terminal crimping position by a predetermined length $h_1$.
Figure 4B:
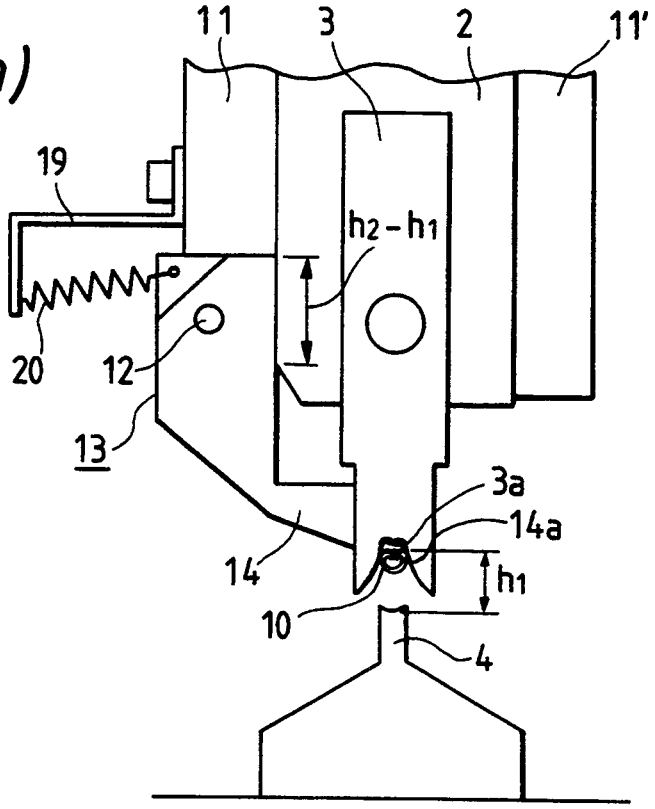
FIG. 4(B) is a front view of the terminal crimping machine shown in FIG. 4(A).

When the crimper 3 (or the ram 2) is raised up by the predetermined height $h_1$ after completion of the terminal crimping operation as shown in FIG. 4(A) and FIG. 4(B), the terminal 10 firmly fitted into and raised up by the crimper 3 collides against the lower end of the terminal disconnecting piece 14 at the terminal disconnecting position, causing the terminal 10 to be squeezed out of a recess portion (i.e., a crimping surface) 3a of the crimper 3 until it is disconnected therefrom.

As is apparent from FIG. 4(B), when an inequality of $h_2 > h_1$ is established between $h_2$ and $h_1$, the stopper 12 can continuously assume the upright standing attitude no matter how far the crimper 3 is raised up.

Figure 5A:
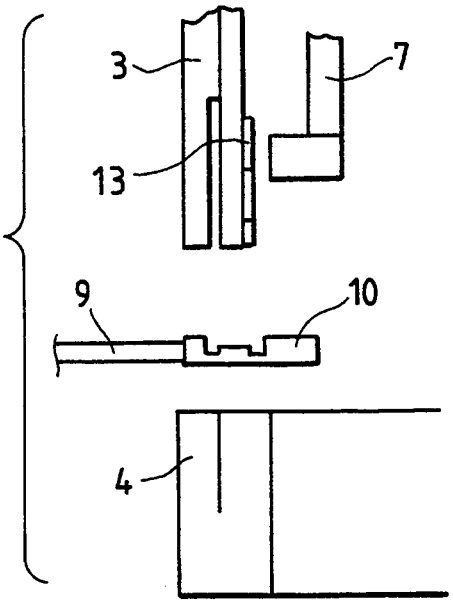
FIG. 5(A) is an illustrative view which shows that the crimper is raised up to reach the upper dead point.
Figure 5B:
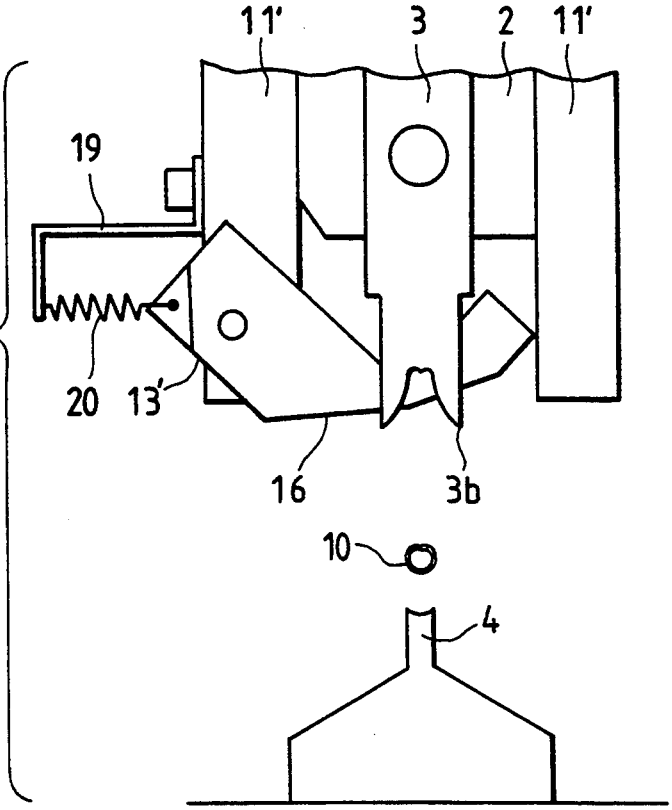
FIG. 5(B) is a front view of the terminal crimping machine shown in FIG. 5(A).

When the crimper 3 (or the ram 2) is raised up to reach an upper dead point as shown in FIG. 5(A) and FIG. 5(B) as it is raised up further, the terminal crimping machine is restored to original state shown in FIG. 1 and FIG. 2. Specifically, the stopper 3 is turned in the clockwise direction by the resilient power of the tension spring 20 so that the outer edge portion 16 of the stopper 13 is completely retracted inside of the crimper 3, resulting in an ample space being maintained between the crimper 3 and the anvil 4. Thus, the terminal 10 or the cable 9 integrated with the latter is conveyed without any occurrence of interference with the stopper 13 regardless of slight bending of the terminal 10 or the cable 9 integrated with the latter.

In this embodiment, a quantity of bending of the cable 9 caused when the terminal 10 is raised up and fitted into the crimper 3 can be reduced by shortening the height $h_1$ of the terminal disconnecting piece 14 as measured from the anvil 4 when the arm piece 15 of the stopper 13 assumes an upright attitude, and moreover, allowing the terminal disconnecting position to approach the anvil 4 as far as possible. While the relationship between $h_2$ and $h_1$ as represented by an inequality of $h_2 > h_1$ is established therebetween, the distance between the crimper 3 located at the upper dead point and the anvil 2 may arbitrarily be determined without any restriction.

Figure 6:
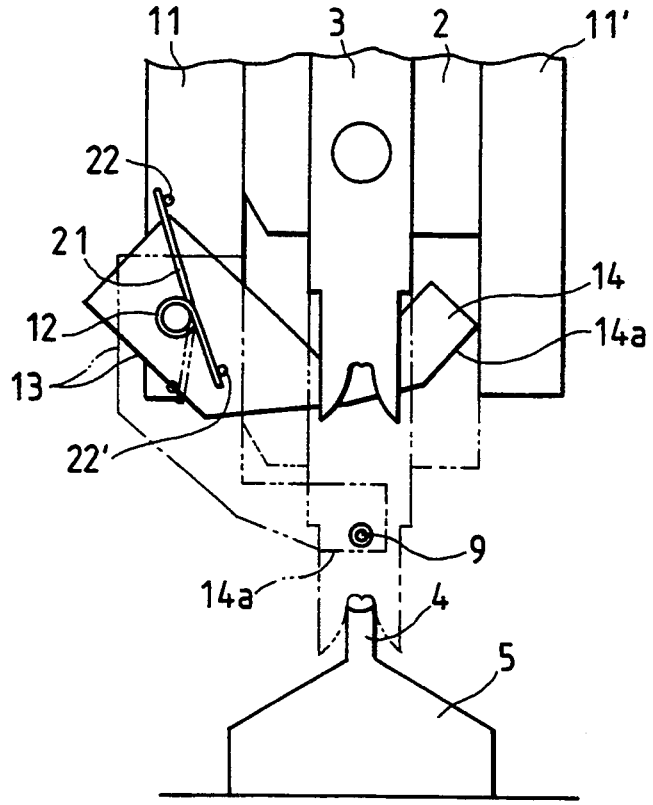
FIG. 6 is a front view of a terminal crimping machine constructed according to another embodiment of the present invention, particularly showing the arrangement of a crimper and an anvil.
Figure 7:
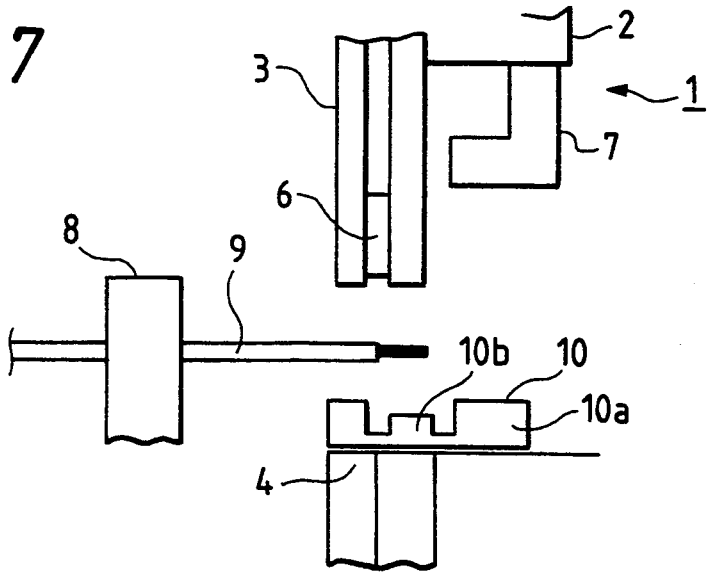
FIG. 7 is a side view of a conventional terminal crimping machine, particularly showing essential components constituting the conventional terminal crimping machine.
Figure 8:
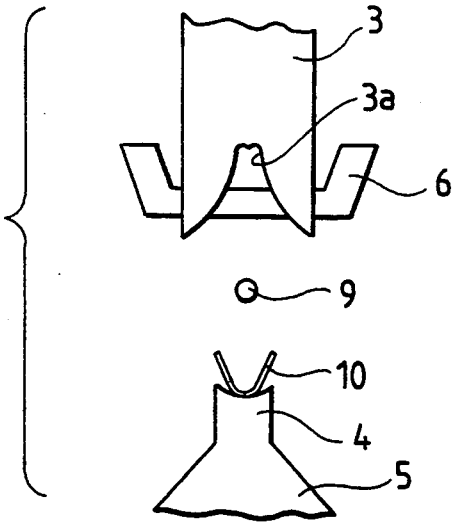
FIG. 8 is a front view of the conventional terminal crimping machine shown in FIG. 7.
Figure 9A:
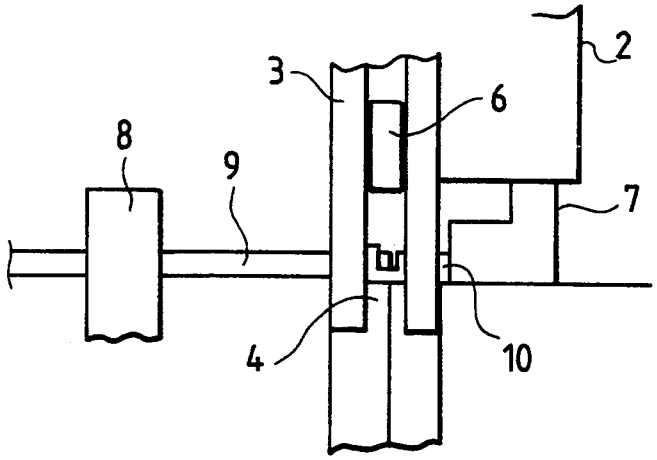
FIG. 9(A) is a side view of the conventional terminal crimping machine shown in FIG. 8 at the time of terminal crimping.
Figure 9B:
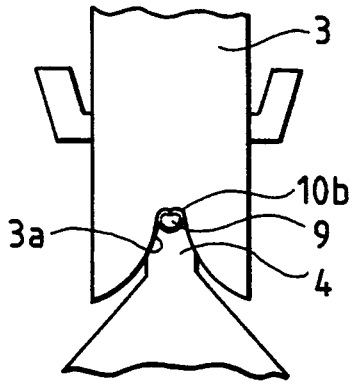
FIG. 9(B) is a front view of the conventional terminal crimping machine shown in FIG. 9(A).
Figure 10A:
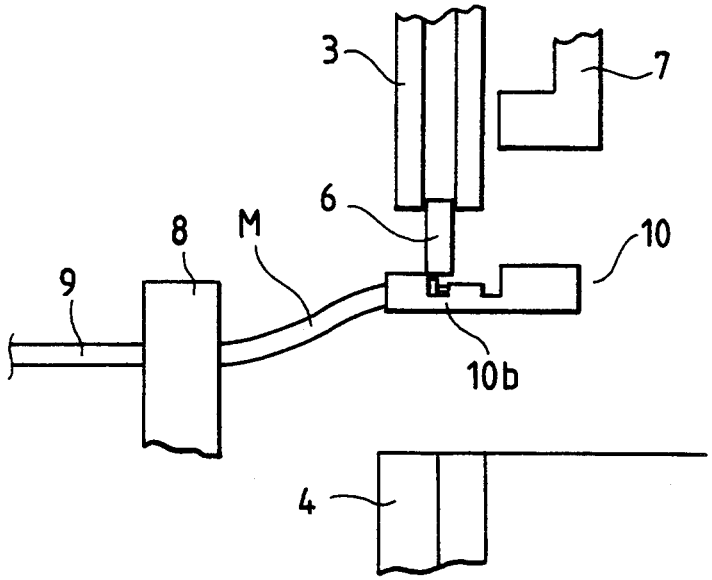
FIG. 10(A) is a side view of the conventional terminal crimping machine, particularly showing the operative state that a terminal fitted into a crimper and raised up together with the crimper is disconnected from the crimper by a stopper.
Figure 10B:
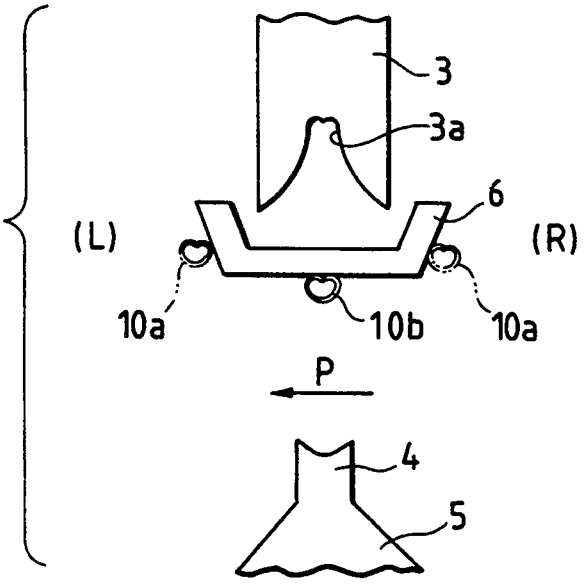
FIG. 10(B) is a fragmentary front view of the conventional terminal crimping machine.
Figure 11:
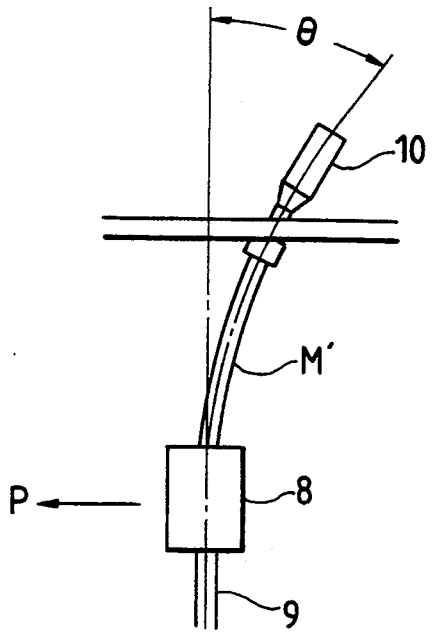
FIG. 11 is an illustrative view which schematically shows that a cable integrated with a terminal is undesirably bent in the rightward direction.

FIG. 6 shows by way of front view a terminal crimping machine constructed according to another embodiment of the present invention, particularly showing the structure of biasing means for a stopper 13. In this embodiment, a twist spring 21 disposed around a pin 12 is substituted for the tension spring 20 in the preceding embodiment, and spring stop pins 22 and 22' are attached to a frame 11 and an arm piece 15. When a ram 2 is raised up to reach the upper dead point, a stopper 3 (i.e., an arm piece 15 of the same) assumes an inclined attitude, and when the ram 2 is lowered to assume the lower dead point, the stopper 3 assumes an upright attitude in the same manner as the preceding embodiment. Thus, repeated description on the foregoing facts will not be required. According to this embodiment, structural components such as a spring fixing piece or the like are not required. This makes it possible to construct the terminal crimping machine in a more simple manner.

With a terminal crimping machine constructed according to the present invention, a stopper including a terminal disconnecting piece and an arm piece integrated with the latter is substituted for a stationary terminal disconnecting stopper of the conventional terminal crimping machine, and the arm piece is turnably disposed on one of a pair of guide frames for properly guiding slidable raising/lowering of a ram. In addition, the terminal crimping machine includes biasing means for normally biasing the stopper toward the crimper side. Thus, when the ram is lowered from the upper dead point to reach the lower dead point, the arm piece assumes an upright attitude due to slidable contact of the ram with the arm piece of the stopper. While the ram is held at the lower dead point, the terminal disconnecting piece is located at the terminal disconnecting position higher than the crimping surface of the crimper by a predetermined distance, and subsequently, when the crimping surface of the crimper is upwardly displaced to the position higher than the terminal disconnecting position, the arm piece is disengaged from the ram so that it is turned to the crimper side by the resilient power of the biasing means to assume an inclined attitude. When the ram reaches the upper dead point, an outer edge portion of the stopper is located inside of the lower end of the crimper. With this construction, after completion of a crimping operation, since anything does not interfere with a terminal or a cable integrated with the latter between the crimper and the anvil, resulting in the cable being few bent. Consequently, any subsequent treatment can smoothly be achieved.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A terminal crimping machine comprising:

a guide frame;

a crimper secured to a ram and vertically moveable along said guide frame, said crimper having a crimping surface;

an anvil located opposite to said crimper, said anvil and said crimper cooperating to crimp a terminal to a cable when said ram and said crimper are moved to a lowermost position; and a stopper for disconnecting said cable from said crimper as said cable, firmly fitted into said crimper, is raised up toward an uppermost position, wherein said stopper includes a terminal disconnecting piece, an arm piece pivotably disposed on said guide frame for supporting the terminal disconnecting piece and biasing means for normally biasing said stopper, wherein as said ram is lowered from the uppermost position to the lowermost position, said ram slidably engages said arm piece so as to move said terminal disconnecting piece downwardly to a terminal disconnecting position located above the crimping surface of said crimper by a predetermined distance, and wherein when said crimper is displaced to the position above the terminal disconnecting position, said arm piece is disengaged from said ram allowing said arm piece (15) to be pivoted to a non-interfering position so that when said ram reaches the uppermost position said terminal disconnecting piece is not disposed between said crimper and said anvil.

2. A terminal crimping machine according to claim 1, in which said biasing means comprises a tension spring and a pin provided on the surface of said guide frame, said stopper being normally biased by the resilient power of said tension spring in such a manner as to pivot the stopper about said pin in the counterclockwise direction.

3. A terminal crimping machine according to claim 1, in which said biasing means comprises:

a twist spring disposed around a pin provided on the surface of said one of guide frames; and spring stop pins attached to said guide frame and said arm piece.

4. A terminal crimping apparatus for crimping a terminal to a cable, comprising:

a guide frame;

an anvil;

a crimper (3) disposed above said anvil and secured to a ram;

moving means for moving said ram, and attendantly said crimper, along said guide frame in a first direction from an uppermost position to a lowermost position at which said terminal is crimped between said crimper and said anvil so as to crimp said terminal to said cable, as a result of which said terminal is retained by said crimper; and a stopper for disconnecting said terminal from said crimper as said crimper is moved in an opposite second direction, said stopper including a pivot arm having a terminal disconnecting portion which is rotatable from a first position to a second position at which said terminal abuts against said disconnecting portion when said crimper is moved in said second direction by a predetermined first distance, wherein movement of said terminal disconnecting portion from said first position to said second position is effected by movement of said crimper in said first direction.

5. The terminal crimping apparatus of claim 4, wherein in said first position said terminal disconnecting portion is disposed above a lowermost portion of said crimper so as to not be disposed between said crimper and said anvil.

6. The terminal crimping apparatus of claim 5, further comprising biasing means for rotating said pivot arm such that said terminal disconnecting portion is disposed in said first position, said rotation to said first position being effected after said ram moves in said second direction by a predetermined second distance which is greater than said predetermined first distance.

* * * * *